United States Patent [19]

Stewart

[11] Patent Number: 4,811,674

[45] Date of Patent: Mar. 14, 1989

[54] FOIL ARRANGEMENT FOR WATER-BORNE CRAFT

[75] Inventor: Leo J. Stewart, Hudson, Canada

[73] Assignee: Motion Design Creations Inc., Hudson, Canada

[21] Appl. No.: 919,220

[22] Filed: Oct. 15, 1986

[51] Int. Cl.[4] ..... B63B 1/28

[52] U.S. Cl. ..... 114/39.2; 114/280

[58] Field of Search ..... 114/39.1, 39.2, 271, 114/274, 278, 280, 284, 126, 129, 132, 143, 56, 57; 441/74, 79

[56] References Cited

U.S. PATENT DOCUMENTS

| | | | |
|---|---|---|---|
| 1,776,700 | 9/1930 | Pegna . | |
| 2,997,260 | 8/1961 | Locke, Jr. . | |
| 2,998,791 | 9/1961 | Light | 114/126 |
| 3,213,818 | 10/1965 | Barkley . | |
| 3,456,609 | 7/1969 | Nott . | |
| 3,459,146 | 8/1969 | Prior . | |
| 3,747,138 | 7/1973 | Morgan . | |
| 3,804,048 | 4/1974 | Cline . | |
| 4,077,077 | 3/1978 | Harper | 114/274 |
| 4,445,452 | 5/1984 | Lock . | |
| 4,493,665 | 1/1985 | Liddle | 441/79 |
| 4,508,046 | 4/1985 | Coulter et al. | 114/274 |

FOREIGN PATENT DOCUMENTS

| | | | |
|---|---|---|---|
| 894306 | 3/1983 | Belgium . | |
| 774363 | 12/1967 | Canada . | |
| 829053 | 12/1969 | Canada . | |
| 996413 | 9/1976 | Canada . | |
| 1187344 | 5/1985 | Canada . | |
| 0059344 | 9/1982 | European Pat. Off. . | |
| 2932750 | 3/1981 | Fed. Rep. of Germany . | |
| 3109307 | 9/1982 | Fed. Rep. of Germany . | |
| 3343579 | 6/1985 | Fed. Rep. of Germany . | |
| 2516472 | 5/1983 | France | 441/79 |

*Primary Examiner*—Sherman D. Basinger
*Assistant Examiner*—Stephen P. Avila
*Attorney, Agent, or Firm*—Robert M. Phipps

[57] ABSTRACT

A water-borne craft includes a hull having a pair of wing-like foils positioned on the bottom of the hull toward the rear or stern portion of the craft and in equally spaced relation on opposite sides of the fore and aft center line or symmetry axis of the hull such that the foils are immersed in the water when in use. The foils are each arranged so as to be movable between a first position such that they meet the relatively moving water and generate a lifting force which reacts with the hull so as to lift the rear portion of the hull upwardly, and a second position wherein no lifting force is generated by the foil as, for example, during turning motion of the hull. By exerting the lifting force on the rear portion of the hull, the planing angle is reduced thus reducing hydrodynamic drag and allowing for an increase in speed.

19 Claims, 5 Drawing Sheets

FIG. 9
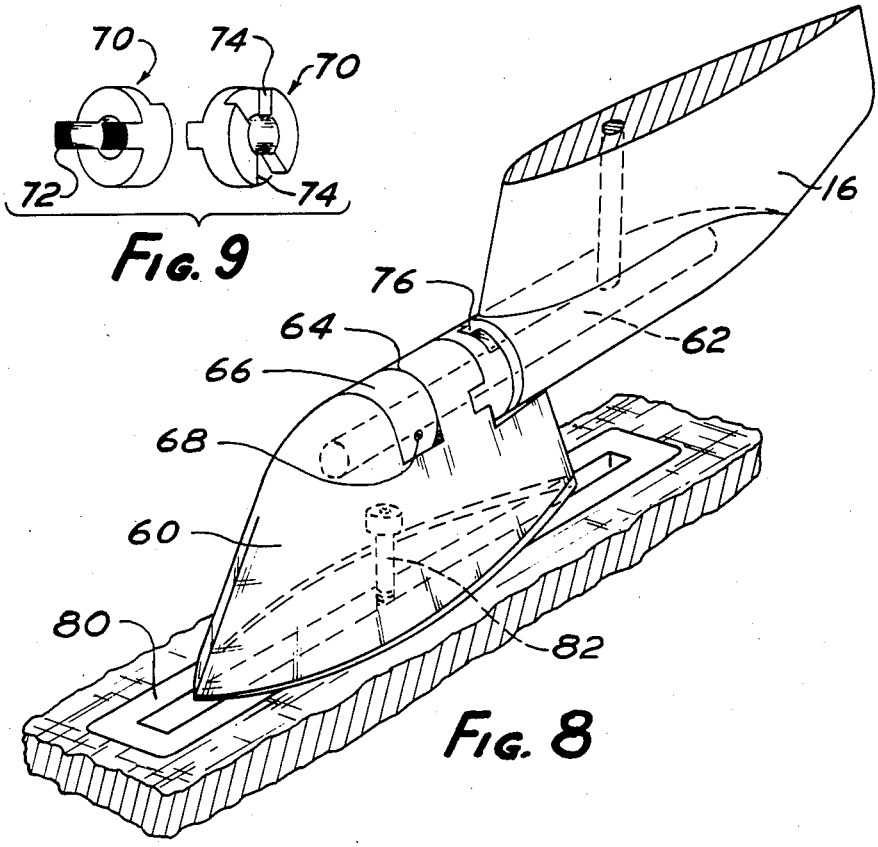
FIG. 8
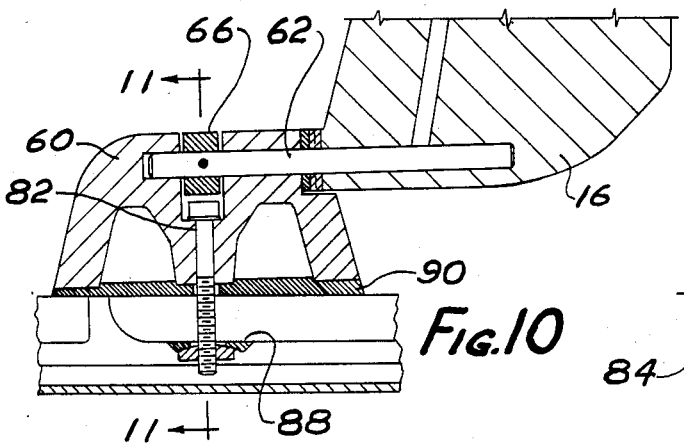
FIG. 10
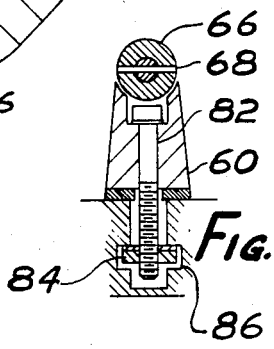
FIG. 11

FOIL ARRANGEMENT FOR WATER-BORNE CRAFT

BACKGROUND OF THE INVENTION

This invention relates to a foil arrangement which can be used to improve the efficiency, speed, and stability of water-borne craft, both displacement and planing hull types, whether powered by sail or other means. The foil arrangement can be fitted on new as well as existing watercraft.

Although the invention is considered to be of general applicability, the invention will be described with particular reference to sailboards.

A great variety of sailboards are used today. A brief review of the Windsport Magazine Directory board selection chart for 1986 will give some idea of the diversity of size, weight and style of board available. The sailboards listed under "all round recreational" are generally for beginners. At the other end of the spectrum are the "high wind boards" which, while demanding considerable skill from the sailor, provide much greater speed and maneuverability than is possible from the "recreational boards".

The lifting foils, in accordance with the present invention, are designed mainly with high performance boards in mind although, as noted above, the invention can be used in a wide variety of applications.

It is well known that all sailboards sail with a "nose up" attitude. This is due to a combination of factors including hull shape, volume and the hydrodynamic forces acting on the hull. The location of the center of gravity is also of significance. Sailboard hulls typically weight from as little as 12 or 14 pounds to over 40 pounds. This weight is distributed more or less uniformly along the hull length. The mast weighs from as little as four pounds to approximately ten pounds. The sailor obviously contributes the greatest weight and therefore has the greatest effect on the location of the center of gravity.

The sailor, in order to control the sail on the board, must position himself generally toward the rear of the board as illustrated in FIG. 1A. The sailor's position is constantly changing in response to change in wind and/or wave conditions and to the maneuvres the sailor wishes to execute with the board; however, apart from a few, very special exceptions, the sailor's weight is toward the rear. Referring again to FIG. 1A, there is shown a fairly typical representation of a sailboard under way with the sailor positioned on the board for good control of the sail and the board. Under some conditions he could be further aft. With further reference to FIG. 1A, the front of the sailboard is out of the water from a point just rearwardly of the mast. It will also be noted that the wake is curling over the rear deck so that the stern is essentially buried in the wake. This condition causes a substantial amount of drag. This condition, while common, is not always present. FIG. 1B shows a side elevation view of the same board and it will be noted from this that the planing angle of the board is about 8°. This is by no means uncommon for sailboards. The effect of the sailor's weight is indicated with an arrow pointing downward from the center of gravity of his body. The downward component of the hydrodynamic forces on the hull is indicated by an arrow pointing downwardly just forward of the fin.

The high planing angle of a typical sailboard is due mainly to hydrodynamic forces which differ from those normally experienced with a typical planing hull because of the sharply tapered stern characteristic of a typical sailboard. (The sailor's weight, of course, contributes to increasing this angle still further.) The widest point of the sailboard hull is typically close to or even forward of the center of the hull. The pointed stern (pointed as opposed to a wide flat transom), while proven by experience to be the best compromise for best overall performance on a sailboard, nevertheless imposes severe penalties insofar as planing efficiency is concerned.

Reference may be had to the text "Boating in Canada", Practical Piloting and Seamanship, Second Edition, University of Toronto Press, Garth Griffiths, ISBN 0-8020-1817-3 at page 128, where in describing typical planing hulls, it is stated that "the beam of the cross sections does not diminish greatly from amid ship to transom; the width of the planing surface is maintained". A further quote from page 128 of the same text states: "The most effective angle of plane will probably be between 4.5° and 5.5°". Another text entitled "Fluid-Dynamic Drag" by Sighard F. Hoerner, Library of Congress Catalogue Card No. 64-19666, at Chapter 11 page 32, shows the lift/drag ratio of four different shapes of hydro-ski. Among the hydro-skis shown, the flat triangular planform hydro-ski is very close to the stern shape of a sailboard. Examination of the graph provided shows its best lift to drag ratio is at a 5° planing angle.

Using the data from the above two reference books, it can be said:

(1) An inwardly tapering stern on a planing hull tends to be inefficient and increases the planing angle to an undesirable degree which, in turn, increases drag and reduces speed.

(2) The optimum planing angle for a planing hull is between 4.5 and 5.5 degrees.

(3) The optimum planing angle for a sailboard with a stern similar to the hydro-ski discussed above is also about 5°.

From the above, and from other observations, the conclusion was drawn that if the planing angle of the sailboard could be reduced to about 4 or 5 degrees, the hydrodynamic drag of the hull would also be reduced which, in turn, would result in greater speed.

SUMMARY OF THE INVENTION

It is therefore a basic object of the invention to provide a water-borne craft, particularly a sailboard, which is provided with means providing for a reduction of the planing angle thereby to reduce drag and allow greater speed.

A more specific object of the invention is to provide fully submerged hydrofoils in conjunction with such watercraft thereby to generate sufficient lift to raise the stern of the watercraft sufficiently as to reduce the planing angle, thus reducing overall drag and allowing for an increase in speed.

Accordingly the present invention, in one aspect, provides a water-borne craft including a hull having a pair of wing-like foils positioned on the bottom of the hull toward the rear or stern portion of the craft and in equally spaced relation on opposite sides of the fore and aft center line or symmetry axis of the hull such that the foils are substantially fully immersed in the water when in use. The foils are each arranged so as to be movable between a first position such that they meet the relatively moving water and generate a lifting force which reacts with the hull so as to lift the rear portion of the hull upwardly and a second position wherein no lifting force is generated by the foil as, for example, during turning motion of the hull. By exerting the lifting force on the rear portion of the hull, the planing angle is reduced thus reducing hydrodynamic drag and allowing for an increase in speed.

As a further feature of the invention, the foils, in the above-noted first position, extend downwardly and outwardly away from one another. In a typical version of the invention, these foils, when in the first position, extend downwardly and outwardly away from one another at an angle between about 40° and about 60° from the vertical.

As a further important feature of the invention, the foils are hinged to the hull for free pivotal movement between the first and second positions. The hinge for each foil is located with its pivot axis generally in a fore and aft position and at or near the root end of the lifter foil, i.e. close to where the foil attaches to the hull. The hinges allow the foils to swing from their lifting positions (wherein they extend downwardly and outwardly away from one another as described above) to a straight down or vertical position. Built in stops limit the movement of the foils between the two positions noted above. The hinges perform an important function when the vessel is turning. During a turn, when the stern moves toward the outside of the turn, the foil on the outside of the turn would, in the absence of a hinge, tend to "dig-in" causing a downward pull rather than an upward lift. The hinge prevents this "digging-in" condition from occurring by allowing the outside foil to swing downwardly to the vertical position while in the turn. In the vertical position, the foil acts as a stabilizer for the duration of the turn. The foil reverts back to its lifting position automatically at the end of the turn when the craft again is on a substantially straight course.

The invention further provides a foil assembly adapted to be fitted to existing craft in order to accomplish the objectives noted above.

A preferred embodiment of the invention will now be described by way of example with reference to the accompanying drawings. Although the invention is illustrated with particular reference to a sailboard, those skilled in the art will appreciate that the invention is applicable to other forms of water-borne craft as well.

BRIEF DESCRIPTION OF THE DRAWINGS

FIG. 8 is a perspective view of a modified form of lifting foil assembly adapted to be retrofitted directly in the existing thruster track of a sailboard;

FIG. 9 shows perspective views of the foil pivot motion stop means for the embodiment of FIG. 8;

FIG. 10 is a longitudinal section view of the embodiment of FIG. 8; and

FIG. 11 is a cross-section view taken along line 11—11 of FIG. 10.

DETAILED DESCRIPTION OF PREFERRED EMBODIMENTS

Figure 1A:
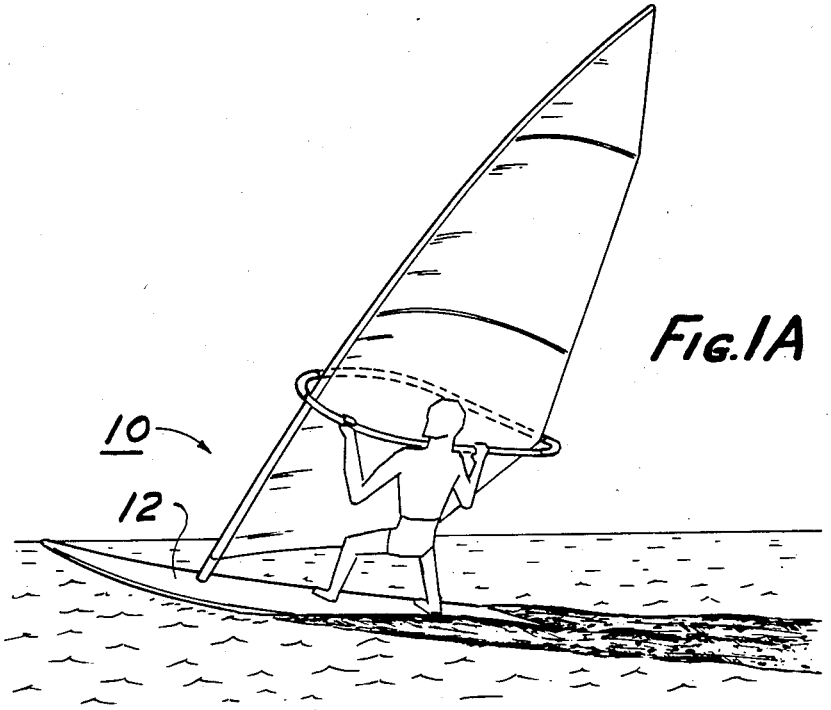
FIG. 1A is a pictorial representation of a typical prior art sailboard illustrating the relatively large planing angle, with the stern portion being buried in the wake.
Figure 1B:
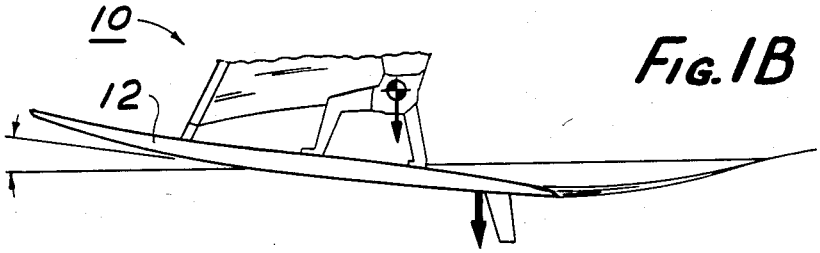
FIG. 1B is a fragmentary side elevation view of the sailboard of FIG. 1A with arrows illustrating certain of the forces acting on the sailboard during use and further illustrating the relatively large planing angle.
Figure 1C:
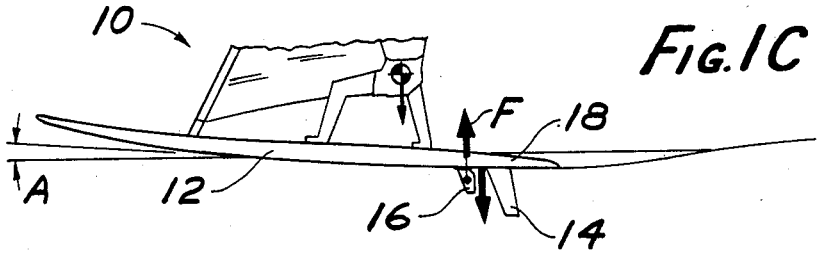
FIG. 1C is a further fragmentary side elevation view of a sailboard fitted with lifting foils in accordance with the invention and further illustrating the lifting force as generated by the lifting foil thus resulting in a smaller planing angle.

A brief reference has been made to FIGS. 1A, 1B and 1C previously. With reference to FIGS. 1A and 1B, it will be noted that the bow of the sailboard is well out of the water up to a point somewhat rearwardly of the mast location. The stern is well down in the water thus producing a relatively large stern wave which tends to curl over the rear deck of the sailboard. From observation and experience, the planing angle when moving at relatively high speed under normal conditions, is about 8°. These conditions give rise to relatively high hydrodynamic drag thus substantially limiting the velocity of the craft.

In FIG. 1C, the same sailboard 10 is illustrated including a typical sailboard hull 12 having a rear fin 14 projecting downwardly from the center line of the hull closely adjacent the stern. In accordance with the invention, this hull is fitted with a pair of lifting foils 16 located in equally spaced relationship on opposing sides of the center line forwardly of the fin 14. As the sailboard moves forwardly through the water, the foils 16 exert an upward lifting force F on the stern portion of the craft thus reducing the planing angle A substantially while at the same time the stern wave is shallower than hitherto (indicating less drag) thus producing a smaller wake which does not tend to curl over the rear deck portion 18 of the sailboard.

Figure 2:
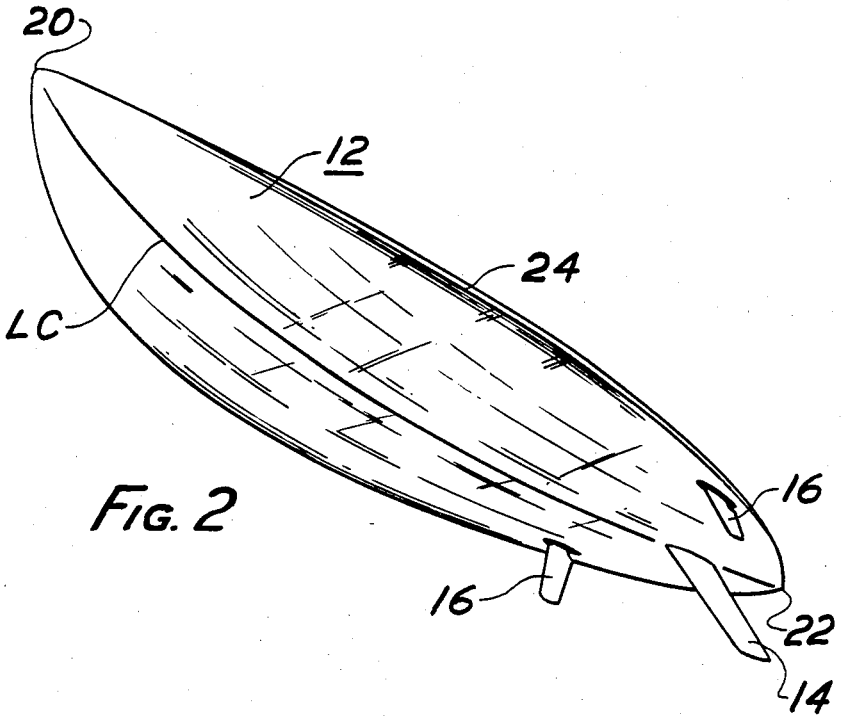
FIG. 2 is a perspective view looking generally toward the underside of a typical sailboard which has been fitted with lifting foils in accordance with the present invention.
Figure 3:
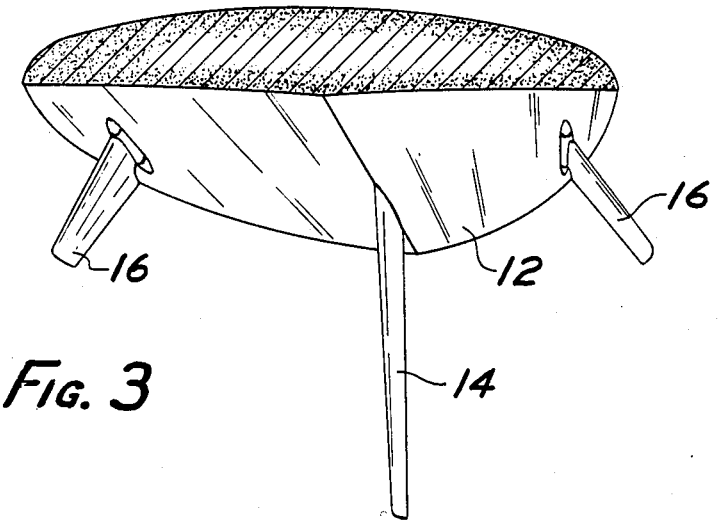
FIG. 3 is a further perspective view of the rear portion only of a sailboard incorporating lifting foils in accordance with the invention.

With reference to FIG. 2, a typical sailboard hull 12 is again shown, such hull 12 including a bow 20, a stern 22, with the previously noted fin 14 being positioned closely adjacent the stern and aligned with the fore and aft center line LC of the hull. The hull shape can be of any well known commercially available variety, or it may be any of the many custom hulls in use. The hull width is greatest in the mid-length region with the width gradually reducing toward the stern.

The wing-like lifting foils 16 are positioned on the bottom surface of the hull forwardly of the fin 14 in equally spaced relation to the center line LC and fairly close to the outside edge or rail 24 of the hull as shown in the drawings. The precise location of lifting foils 16 is not critical and will vary depending on the hull/foil combination. However, since the main objective is to lift the stern of the sailboard upwardly it will be apparent to those skilled in this art that the lifting foils should be positioned on the rearward part of the hull. While the main purpose of the lifting foils 16 is to lift the stern, it may be found that a slightly more forward location than immediately ahead of the fin 14 is desirable for the reason that any lift produced over that required to raise the stern so that the hull is at an efficient planing angle may tend to reduce the planing angle to below the optimum and to increase the wetted area—thus increasing drag.

If however, the lifting foils 16 are slightly forward of what has been considered to be the best location from the point of view of lifting the stern only, then any excess lift over that required to reach the optimum planing angle would tend to raise the whole craft slightly thus reducing the wetted area and reducing drag still further. To enhance lateral stability, it is at the same time desirable that the foils 16 be spaced apart a reasonable distance and for this reason they are positioned relatively close to the outside edge or rail 24 of the hull. At the same time it has to be kept in mind that interference with the fin 14 is to be avoided so in most cases the best compromise is to position the foils 16 somewhat forwardly of fin 14 as illustrated in the drawings.

Figure 4:
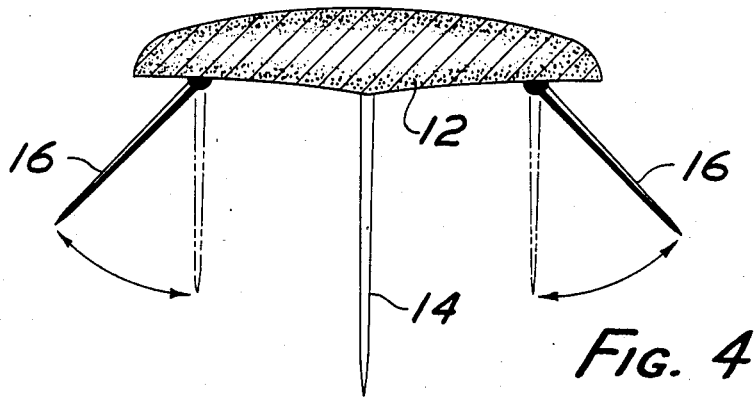
FIG. 4 is a cross-section view of the sailboard looking rearwardly along the center line of the sailboard and illustrating the pivotal movement of the lifting foils from outwardly angled lifting positions to vertically downward turning positions.

Both foils are pivotally connected to hull 12 for movement between a first lifting position wherein the foils extend downwardly and outwardly away from one another as best illustrated in FIG. 4. In this lifting position, each foil 16 forms an angle between about 40° (preferably about 45°) and about 60° from the vertical. The foils can pivot inwardly to a second position illustrated in dashed lines in FIG. 4, which second position is vertically downward, generally at right angles to the hull and in parallelism to the fin 14. Suitable stops to be described hereafter limit the movement of foil 16 between the two positions.

Figure 7:
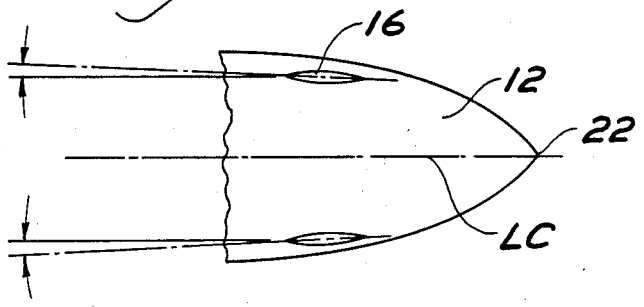
FIG. 7 is a bottom plan view of the rear portion of a sailboard hull illustrating particularly the manner in which each lifting foil is provided with a positive angle of attack.

The pivot axes defined by the hinges to which the foils 16 are mounted are located in close juxtaposition to the bottom surface of the hull. Each hinge pivot axis extends substantially in a fore and aft direction with the hinge pivot axis being angled such that each lifting foil 16 is provided with a slight angle of attack such that during forward movement of the sailboard the lifting foils 16 are caused to move to the outwardly angled positions illustrated in FIG. 4 thereby to provide the desired lifting effects. These hinge pivot axes, when viewed from under the hull, as illustrated in FIG. 7, are angled outwardly at about 3° measured relatively to the hull center line LC. The 3° angle relative to the hull line appears to do three things:

(1) When the lifting foil 16 swings outwardly to the angled lifting position, (preferably a 45° angle), the 3° angle of the hinge pivot axis results in a 3° angle of attack between foil 16 and the water which is relatively flowing over it. This angle of attack generates lift as the foil moves through the water.

(2) When the sailboard completes a turn and is on a generally straight course again, because of the 3° angle of attack, the water generates a positive pressure on the inside surface of the foil which was in the vertical position during the turn thus pushing it outwardly toward the 45° angle position where it again resumes its lifting function.

(3) When the foil is in its vertical position (because it is on the outside of the turn) it acts as an additional fin thus adding to the stability provided by the regular fin 14. Because of the 3° angle it actually augments the turn, i.e. it tends to steer the sailboard into the turn thus making faster turns and jibes possible. This helps to increase the overall speed of the craft since by cutting down the time spent at the lower speed experienced in a turn, one can more quickly return to the faster speed achieved in sailing a straight course.

Symmetrical foils as described above eliminate "handed" foils, i.e. foils 16 as described are interchangeable. However, it is within the scope of this invention to use cambered (asymmetrical) foils as well, in which event a positive attack angle e.g. the 3° angle noted above, is not needed. Cambered foils have been in common use in air and water craft for decades; see, for example, the discussion given in Aircraft Layout & Detail Design, by Newton H. Anderson B.S., First Edition, McGraw-Hill Book Co., New York & London, 1941, Chapter 3 page 73 et seq.

Another advantage of the lifting foils during the course of the turn is that the foils, by quickly lifting the stern to an optimum planing position as the sailboard comes out of a turn, create a higher acceleration from the lower speed of the board in the turn to the higher speed achieved when sailing a straight course.

As noted previously, by providing a hinge mounting, the individual foils 16 when on the outside of a turn, can swing downwardly from the lifting position to the vertical position thus eliminating the "digging-in" problem noted previously. Incorporated in each hinge assembly is the means for limiting movement of the foil between the vertical position and the angled position, e.g. at 45°. The lifting angle, as noted above, can vary quite widely and an angle of 45° may be chosen as a compromise between the increasing vertical lift component as the lifting foils 16 are moved closer to the horizontal, balanced against increasing interference drag between the lifting foils 16 and the hull as the angle there-between decreases. While on the subject of interference drag, it should also be noted that the lifting foils 16 are also positioned far enough apart laterally to avoid interference drag between the two lifting foils themselves. Increased interference drag may also be created if the foils are positioned too close to the fin 14.

Figure 5:
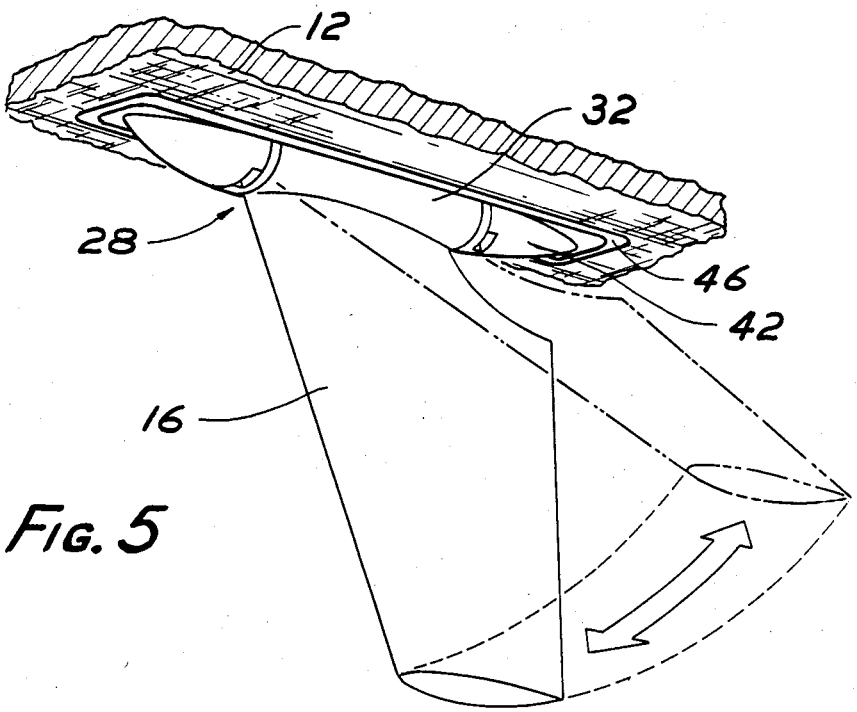
FIG. 5 is a further perspective view illustrating a single lifting foil assembly when installed on the bottom of a sailboard hull.

With reference to FIG. 5, it will be noted that the hinge assembly 28 is smoothly streamlined and since the center line of the hinge substantially coincides with the bottom surface of the hull, at least one half of the hinge and its associated stop mechanism is disposed inside the contour of the hull thus keeping drag low.

Figure 6:
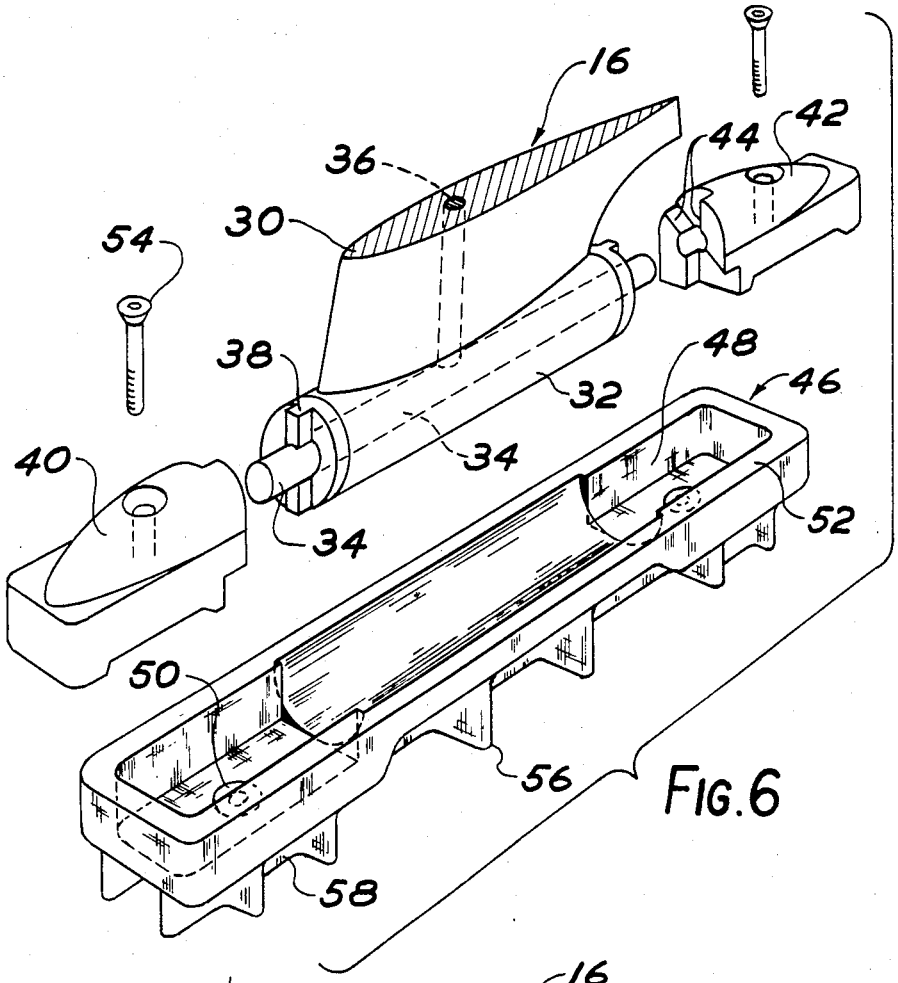
FIG. 6 is an exploded view of one complete lifting foil assembly including a hinge and associated stop means.

A complete lifting foil assembly is illustrated in FIG. 6. The lifting foil 16 includes the wing-like foil element 30 which is a plastic moulding having an integrally formed cylindrical portion 32 formed to its inner end with an elongated hinge pin 34 passing through the cylindrical element and having its opposite ends projecting outwardly thereof. A rod element 36 welded to hinge pin 34 at approximately right angles thereto extends a substantial distance through the interior of the wing-like foil element 30 thereby providing substantial structural strength. Stop members 38 are welded to the outwardly projecting end portions of hinge pin 34. The opposing ends of hinge pin 34 extend into suitable apertures provided in the opposed retainer members 40 and 42. Retainer members 40 and 42 are provided with angularly spaced apart shoulders 44 which engage with the stops 38 thereby to provide the turning position and the lifting position for each foil as illustrated in FIG. 4. The retainers may be made from moulded plastic or die cast metal. They are identical except for the shoulder arrangements 44 which make them handed parts. It might be noted here that the parts providing the foil assembly with a left hand movement are identical to the parts of a lifting foil assembly with a right hand movement. Left hand movement can be changed to right hand movement simply by switching the positions of the retainers 40 and 42.

The lifting foil assembly further includes a base assembly 46 comprising an elongated generally rectangular plastic moulding having an elongated recess 48 extending the length thereof and sized to receive the retainers 40 and 42 and the inner end of the wing-like foil including items 32, 34 and 38 as noted above. The base assembly includes two threaded metal inserts 50 which are moulded in place. The base assembly is designed to be fixed in place in a suitably sized recess formed in the sailboard hull. Accordingly, its bottom surface is provided with suitable ribs 56 and channels 58 of any desired size and shape as to provide increased surface area to be engaged by adhesive or cement (preferably epoxy). The facing surface 52 of the base assembly is positioned flush with the bottom surface of the hull. Screws 54 hold the retainers 40 and 42 in place within the base assembly 46. When the assembly has been fitted together, the stops 38 on hinge pin 34, in conjunction with the shoulders or ledges 44 on the retainers 40 and 42, serve to limit the movement of the lifting foils 16 between the vertical position and the angled position (preferably 45°). In other words, the angular relationship between shoulders 44 is such that the square lugs forming part of stops 38 are limited, in the preferred embodiment, to angular movement of about 45° about the hinge pivot axis which, of course, similarly limits the angular movement of lifting foils 16.

EXAMPLE

A set of lifting foils has been designed for. positioning on the bottom surfaces of a sailboard in accordance with the criteria referred to above. The foil design has the following characteristics:

length of each foil: 7 inches (hinge center line to tip)
root chord: 4 inches
tip chord: 2¼ inches
area of each foil: 18¾ square inches
root section: NACA 0010
tip section: NACA 0015

The above parameters represent a conservative approach to lifting foil design. The performance of the NACA 4-digit series symmetrical section foil shapes used are predictable and do not require great precision in fabrication to achieve expected results. It is expected that laminar flow sections would result in less drag but would demand much higher precision in fabrication. It is anticipated that the performance of these types of foils would be significantly affected in unpredictable ways by small nicks or scratches on the foil surface. As noted previously, cambered foil sections could also be used. The use of foils having a higher aspect ratio would theoretically provide greater efficiency but could also result in unpredictable problems such as stalling due to twisting of the foil under heavy loadings.

The following additional comments will be of assistance to those skilled in this art. The angular relationships, i.e. the preferred 45° lifting angle and the preferred 3° angle of attack are not necessarily optimal angles. These angles, as well as the foil section, foil area, foil aspect ratio, foil tip shape, foil plan form and other variables can be changed to arrive at a better overall design. Slalom boards, wave boards, speed boards and the like would all have differing requirements which would have to be considered if the optimum design for a particular board is to be achieved.

It is also noted that the structure just described can be fitted to an existing sailboard by cutting recesses in the hull and fastening the lifting wing base assemblies into the recesses. If thruster tracks have already been installed on the sailboard, they would have to be removed or plugged before installing these base assemblies for the lifting foil.

By modifying the design, the lifting foils can also be installed directly in the thruster tracks. Means for adjusting the lifting foil hinge angles must be provided thereby to accommodate varying thruster track installations.

A modified design of this nature is illustrated in FIGS. 8–11. Here the lifting foil 16, of essentially the same design as before, is freely pivotally mounted to a pedestal 60 made of moulded plastic and having a streamlined shape. The root end of foil 16 is provided with a hinge pin 62 which extends forwardly into the outer end portion of pedestal 60. Pedestal 60 has a recess 64 therein which receives a locking ring 66, the latter being fixed to hinge pin 62 by means of a retainer pin 68. Interposed between the foil 16 and pedestal 60 is a stop collar 70 (see FIG. 9) which surrounds hinge pin 62. Stop collar 70 is keyed into the pedestal by a pair of tangs 72 on one face, and on the other face angularly spaced shoulders 74 are provided which cooperate with a lug formed on an annular stop member 76 which is welded to the hinge pin 62. Shoulders 74 and stop member 76 have the same pivot motion limiting function as described with the principal embodiment described previously.

The pedestal 60 is secured in the thruster track 80 of the sailboard hull by means of a socket head screw 82 (FIGS. 10 and 11) which extends through the body of the pedestal and into the slot of the thruster track 80. Screw 82 is threaded into a nut 84 which is retained in the retaining groove 86 of the thruster track. The nut 84 cooperates with a washer 88; both have mating radiused surfaces on one of their faces which allows for some pivotal adjustment of the screw 82 while still retaining good force transmitting contact in the thruster retaining groove 86. This allows a suitably tapered shim 90 to be interposed between pedestal 60 and the outer face of the thruster track (and adjacent hull surface). By using shims of differing taper angle, the foil angle of attack, when in the lifting position, can be changed.

The above-described modification is very useful for fitting the lifting foils to existing sailboards etc. The foil hinge axis defined by this modification is spaced below the hull surface and, by virtue of the pedestal, drag is increased somewhat; however it is still considered to be an efficient design.

A preferred embodiment of the invention has been described by way of example. Those skilled in the art will realize that numerous changes may be made to the details of construction without departing from the spirit or scope of the invention as hereinafter claimed.

I claim:

1. A water-borne craft including a hull, and a pair of wing-like foils positioned on the bottom of the hull toward the rear or stern portion of the craft in equally spaced relation on opposite sides of the fore and aft center line or symmetry axis of the hull so as to be substantially fully immersed in the water when in use, said foils being movable relative to said hull between (A) a first position such that, in use, said foils meet the relatively moving water and generate a lifting force which reacts with the hull so as to tend to lift the rear portion of the hull upwardly and (B) a second position wherein no lifting force is exerted by one or other of the foils, as for example, during turning motion of the hull.

2. The water-borne craft of claim 1 wherein said foils, in said first position, extend downwardly and outwardly away from one another, said hull being a planing hull, and the lifting force being sufficient as to reduce the planing angle of the hull.

3. The water borne craft of claim 1 wherein said foils, in said first position, extend downwardly and outwardly from one another at an angle between about 40° and about 60° from the vertical, and in said second position said foils extend vertically downwardly.

4. The water-borne craft of claim 2 wherein said foils are hinged to said hull for free pivotal movement between said first and second positions.

5. The water-borne craft of claim 3 wherein said foils are hinged to said hull for free pivotal movement between said first and second positions, each hinge center line extending substantially in a fore and aft direction relative to the hull, and said foils being arranged to move to the first position automatically in response to forward movement of said craft along a generally straight course.

6. The water-borne craft of claim 4 wherein that foil which is on the outside of a turn is adapted to pivot from the first position to said second position so that it extends generally vertically downwardly so as to avoid digging in of that foil during the course of the turn while the foil on the inside of the turn remains in said first position and continues to exert a lifting force on the hull.

7. The water-borne craft of claim 2 wherein said foils are hinged to said hull for free pivotal movement between said first and second positions, each hinge center line extending substantially in a fore and aft direction, and stop means to positively limit the movement of said foils between the first and second positions.

8. The water-borne craft of claim 2 wherein said foils are hinged to said hull for free pivotal movement between said first and second positions, each hinge center line extending substantially in a fore and aft direction and being in close juxtaposition to the hull bottom surface, with each hinge center line further being angled outwardly relative to the fore and aft center line as to provide a positive angle of attack.

9. The water-borne craft of claim 5 wherein each hinge centerline is in close juxtaposition to the hull bottom surface.

10. The water-borne craft of claim 5 wherein each hinge centerline is in outwardly spaced relation to the hull bottom surface.

11. The water-borne craft according to claim 2 wherein said hull is a sailboard hull.

12. For use with a water-borne craft including a hull, a foil assembly including wing-like foil means adapted to be secured to the bottom of the hull adjacent the rear of same so as to be substantially fully immersed in the water when in use and to exert a lifting force on the hull during movement through the water, and mounting means for said foil means defining a pivot axis for said foil means such that said foil means can move freely between an outwardly angled lifting position and another position where no lift is exerted, as during the course of changing the hull direction of travel.

13. The foil assembly of claim 12 wherein said mounting means includes stops limiting the angular motion of said foil means between said positions.

14. The foil assembly of claim 12 wherein said mounting means is arranged such that said pivot axis can be located flush with the hull bottom surface, the mounting means being smoothly contoured to reduce drag.

15. The foil assembly of claim 12 wherein said mounting means is arranged such that said pivot axis can be located outwardly in spaced relation to the hull bottom surface.

16. The foil assembly of claim 14 wherein said mounting means is adapted to be affixed in a recess in the hull bottom surface.

17. The foil assembly of claim 15 wherein said mounting means comprises a pedestal which, in use, projects outwardly from the hull bottom surface, said pedestal adapted to be secured to a thruster track of a sailboard.

18. The foil assembly of claim 17 wherein said pedestal includes fastener means for engaging in a retaining groove of the thruster track.

19. The foil assembly of claim 12 wherein the mounting means includes means enabling the angle of attack of the foil means to be changed.

* * * * *